US011332964B2

(12) United States Patent
Strole et al.

(10) Patent No.: US 11,332,964 B2
(45) Date of Patent: May 17, 2022

(54) LATCH ASSEMBLY

(71) Applicant: STRATTEC SECURITY CORPORATION, Milwaukee, WI (US)

(72) Inventors: Michael Strole, Royal Oak, MI (US); Nicholas Schafer, Milwaukee, WI (US); Julie Zier, Milwaukee, WI (US)

(73) Assignee: STRATTEC SECURITY CORPORATION, Milwaukee, WI (US)

( * ) Notice: Subject to any disclaimer, the term of this patent is extended or adjusted under 35 U.S.C. 154(b) by 928 days.

(21) Appl. No.: 15/946,404

(22) Filed: Apr. 5, 2018

(65) Prior Publication Data

US 2018/0291657 A1 Oct. 11, 2018

Related U.S. Application Data

(60) Provisional application No. 62/482,050, filed on Apr. 5, 2017.

(51) Int. Cl.
*E05B 85/26* (2014.01)
*E05B 85/24* (2014.01)
(Continued)

(52) U.S. Cl.
CPC ..... *E05B 85/26* (2013.01); *E05B 81/14* (2013.01); *E05B 81/16* (2013.01); *E05B 81/20* (2013.01);
(Continued)

(58) Field of Classification Search
CPC ..... E05B 84/64; E05B 84/66; E05B 84/68; E05B 81/14; E05B 81/16; E05B 81/18; E05B 81/20; E05B 85/00; E05B 85/243; E05B 85/26; E05B 83/18; E05B 81/64; E05B 81/66; E05B 81/68; Y10T 292/1047; Y10T 292/1082; Y10S 292/23
See application file for complete search history.

(56) References Cited

U.S. PATENT DOCUMENTS

2018/0073284 A1* 3/2018 Im ..... E05B 81/20

FOREIGN PATENT DOCUMENTS

CN 108590385 A * 9/2018
DE 29609770 U1 * 9/1996 ..... E05B 81/66
(Continued)

OTHER PUBLICATIONS

Computer Generated Translation for FR 2804713 A1, Generated on Mar. 5, 2021, https://worldwide.espacenet.com/ (Year: 2021).*
(Continued)

*Primary Examiner* — Alyson M Merlino
(74) *Attorney, Agent, or Firm* — Michael Best & Friedrich LLP

(57) ABSTRACT

A latch assembly includes a forkbolt biased to rotate in a first direction about a first pivot point, and a detent biased to rotate in a second direction about a second pivot point, the detent configured to engage with the forkbolt in at least two different positions. The latch assembly further includes a lever having a first end coupled to the detent and a second end biased toward the forkbolt. The latch assembly further includes a switch configured to detect a position of both the forkbolt and the combined lever and detent.

25 Claims, 10 Drawing Sheets

(51) Int. Cl.

| | |
|---|---|
| ***E05B 81/66*** | (2014.01) |
| ***E05B 81/68*** | (2014.01) |
| ***E05B 81/20*** | (2014.01) |
| ***E05B 83/18*** | (2014.01) |
| ***E05B 81/14*** | (2014.01) |
| ***E05B 81/16*** | (2014.01) |
| ***E05B 85/00*** | (2014.01) |

(52) U.S. Cl.

CPC ..... *E05B 81/66* (2013.01); *E05B 81/68* (2013.01); *E05B 83/18* (2013.01); *E05B 85/00* (2013.01); *E05B 85/243* (2013.01); *E05Y 2201/43* (2013.01); *E05Y 2900/546* (2013.01)

(56) References Cited

FOREIGN PATENT DOCUMENTS

| | | | | | |
|---|---|---|---|---|---|
| DE | 19905774 | A1 * | 8/2000 | ..... | E05B 85/26 |
| DE | 102005056788 | A1 * | 5/2007 | ..... | E05B 81/20 |
| DE | 102007056251 | A1 * | 1/2009 | ..... | E05B 81/68 |
| EP | 1512815 | A1 * | 3/2005 | ..... | E05B 85/26 |
| FR | 2804713 | A1 * | 8/2001 | ..... | E05B 81/20 |

OTHER PUBLICATIONS

Computer Generated Translation for De 19905774 A1, Generated on Mar. 5, 2021, https://worldwide.espacenet.com/ (Year: 2021).*

* cited by examiner

LATCH ASSEMBLY

CROSS-REFERENCE TO RELATED APPLICATIONS

This application claims priority to U.S. Provisional Application No. 62/482,050, filed Apr. 5, 2017, the entire contents of which are incorporated herein by reference.

FIELD OF THE INVENTION

The present invention relates to latch assemblies, and more specifically latch assemblies for motor vehicles.

BACKGROUND OF THE INVENTION

Many current motor vehicles include compartments (e.g., hoods, rear compartments, lift gates) that are latched with latch assemblies. The latch assemblies enable an operator to push down on the compartment, and to have the compartment latched and locked in place until the operator desires to unlatch the compartment.

SUMMARY OF THE INVENTION

In accordance with one construction, a latch assembly includes a forkbolt biased to rotate in a first direction about a first pivot point, and a detent biased to rotate in a second direction about a second pivot point, the detent configured to engage with the forkbolt in at least two different positions. The latch assembly further includes a lever having a first end coupled to the detent and a second end biased toward the forkbolt. The latch assembly further includes a switch configured to detect a position of both the forkbolt and the combined lever and detent.

In accordance with another construction, a latch assembly includes a housing, and a forkbolt coupled to the housing, the forkbolt biased to rotate in a first direction about a first pivot point. The latch assembly further includes a detent coupled to the housing, the detent biased to rotate in a second, opposite direction about a second pivot point. The latch assembly further includes a lever coupled to the detent. The latch assembly further includes a first switch configured to detect a surface of the lever, and a second switch configured to detect a surface of the detent. The first switch is configured to detect a position of both the forkbolt and the combined detent and lever. The first switch is configured to transition between an activated and a deactivated state based on movement of the forkbolt and the combined detent and lever.

Other features and aspects of the invention will become apparent by consideration of the following detailed description and accompanying drawings.

Figure 1:
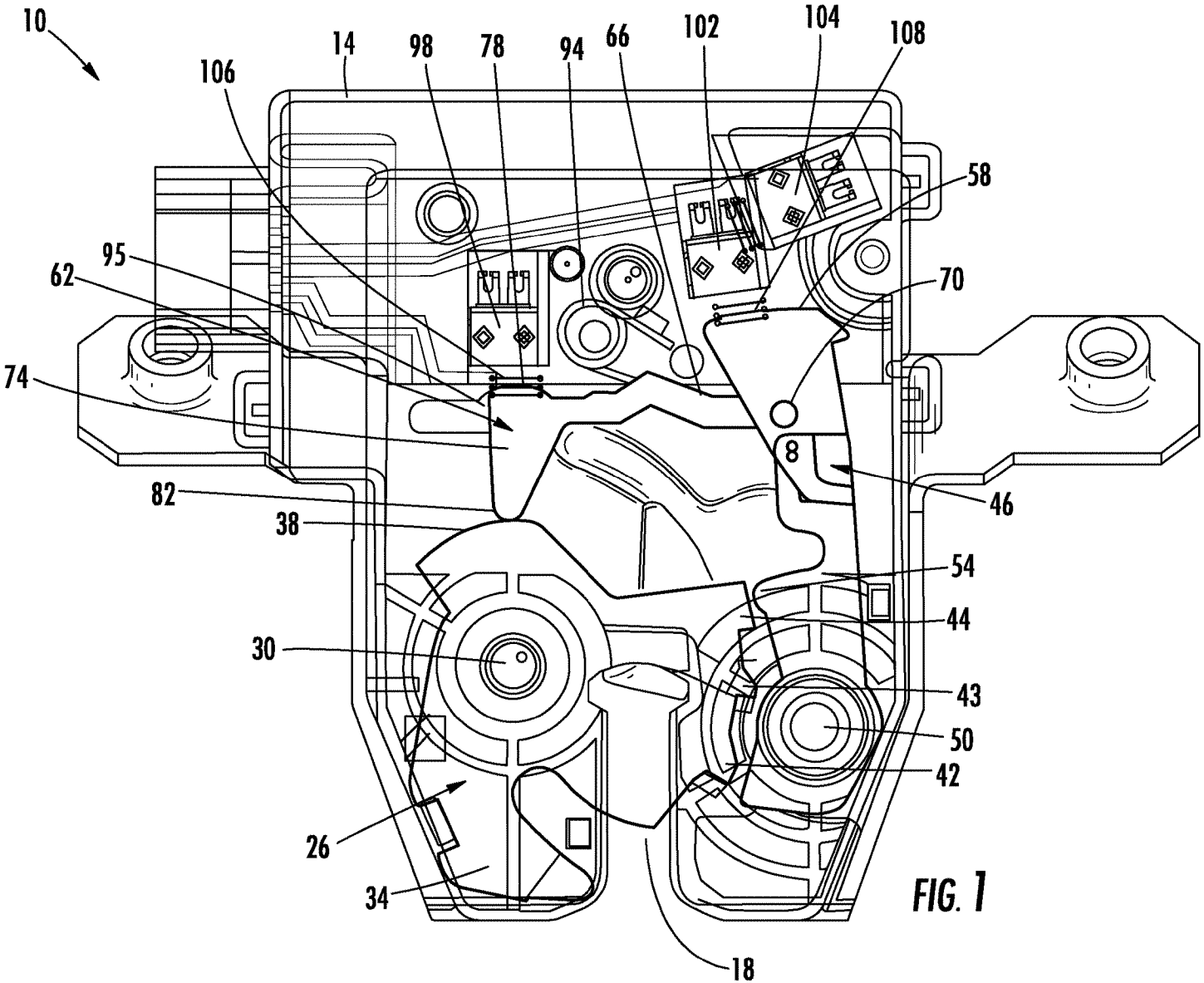
FIG. 1 is cross-sectional view of a latch assembly according to one construction, illustrating a fully open position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-5 illustrate a latch assembly 10. While the latch assembly 10 is primarily intended for use with a commercial motor vehicle (e.g., sedan, SUV, minivans, trucks, etc.) for a cinching rear compartment latch, the latch assembly 10 may also be used with other types of machines or vehicles where a latch assembly 10 may be beneficial to control operation of a compartment.

With reference to FIGS. 1-5, the latch assembly 10 includes a housing 14 defining a fishmouth (i.e., slot) 18 that is sized and shaped to receive a striker 22 (illustrated schematically in FIGS. 2 and 3) of a compartment of a motor vehicle. The housing 14 may have shapes and sizes other than that illustrated. In some constructions, the housing 14 is coupled (e.g., fixed) directly to an interior of a motor vehicle, adjacent a compartment of the motor vehicle.

The latch assembly 10 further includes a forkbolt (i.e., catch) 26 disposed at least partially within the housing 14. The forkbolt 26 rotates about a forkbolt pivot point 30 (e.g., pin) in the housing 14. In the illustrated construction, the forkbolt 26 is biased (e.g., with a torsion spring or other biasing element) to rotate clockwise about the forkbolt pivot point 30, although other constructions include different rotational directions or movement of the forkbolt 26, as well as different biasing elements to bias the forkbolt 26. In the illustrated construction, the forkbolt 26 includes a forkbolt main arm 34, a forkbolt engagement surface 38 (e.g., a cam surface), a first forkbolt latching projection 42, a second forkbolt latching projection 43, and a third forkbolt latching projection 44.

With continued reference to FIGS. 1-5, the latch assembly 10 further includes a detent (i.e., pawl) 46 disposed at least partially within the housing 14. The detent 46 rotates about a detent pivot point 50 (e.g., pin) in the housing 14. In the illustrated construction, the detent 46 is biased (e.g., with a torsion spring or other biasing element) to rotate counterclockwise about the detent pivot point 50, although other constructions include different rotational directions or movement of the detent 46, as well as different biasing elements to bias the detent 46. In the illustrated construction, the detent 46 includes a detent latching projection 54, and a detent sensed surface 58 at a distal end of the detent 46. The detent latching projection 54 is disposed between the detent sensed surface 58 and the detent pivot point 50.

The latch assembly 10 further includes a lever 62 disposed at least partially within the housing 14. The lever 62 is coupled to the detent 46, and is moved by the detent 46 during operation of the latch assembly 10. In the illustrated construction, the lever 62 includes a first end 66 that is coupled to the detent 46 at a point or area 70 (e.g., via press-fit, pivotal connection, integrally formation with the detent, a sliding connection via a slot, or other connection). The point or area 70 is disposed between the detent sensed surface 58 and the detent latching projection 54. The lever 62 further includes a second, opposite end 74 having a lever sensed surface 78 and a lever engaging surface 82. In the illustrated construction the second end 74 of the lever 62 has a generally enlarged (e.g., triangular) shape. The lever engaging surface 82 is a generally rounded surface of small radius, whereas the lever sensed surface 78 is generally larger and planar or in some constructions is curved or is a cam surface. Other constructions include different shapes and sizes for the lever 62 and its various surfaces and regions other than that illustrated.

Figure 3:
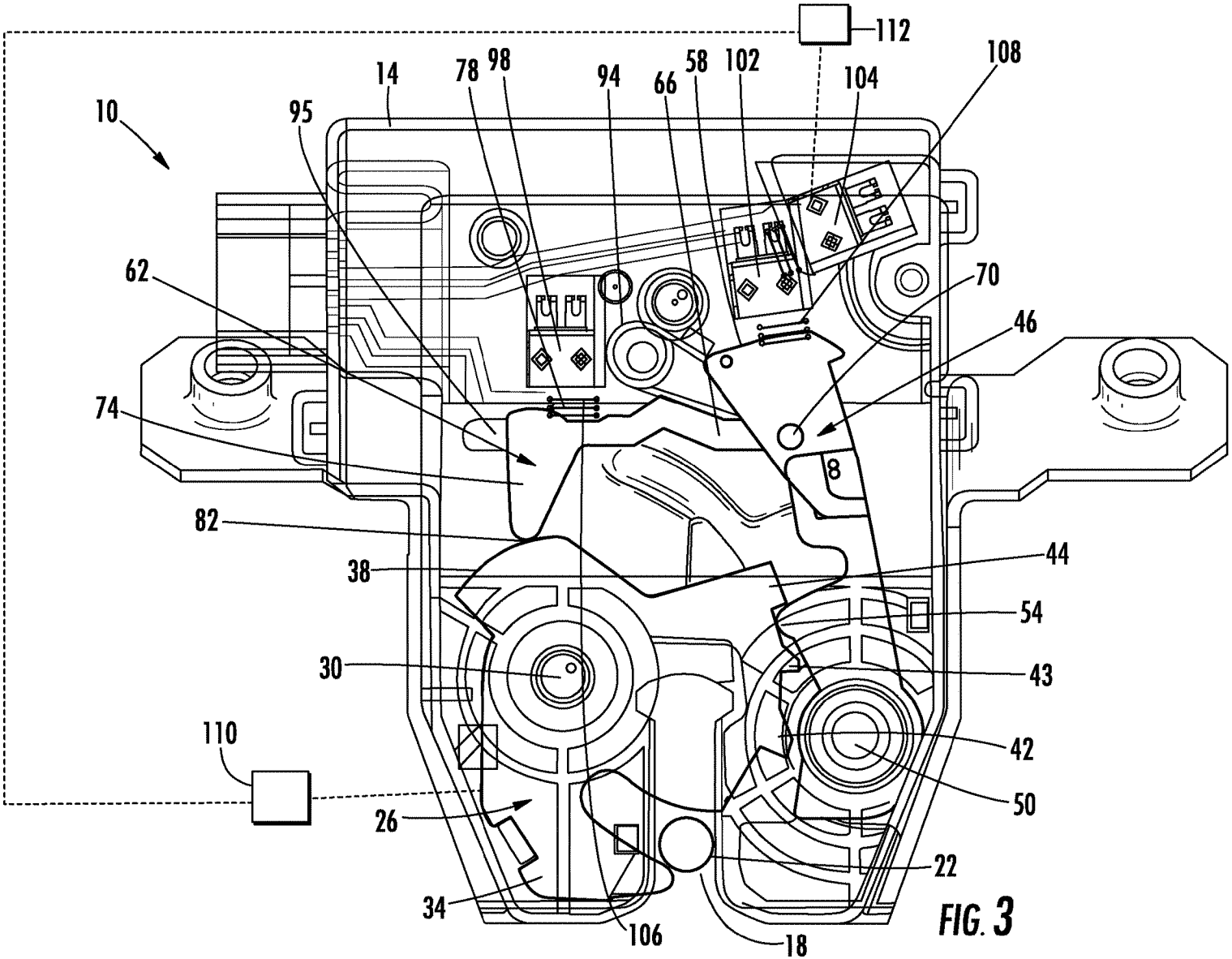
FIG. 3 is a cross-sectional view of the latch assembly of FIG. 1, illustrating a tertiary position.
Figure 4:
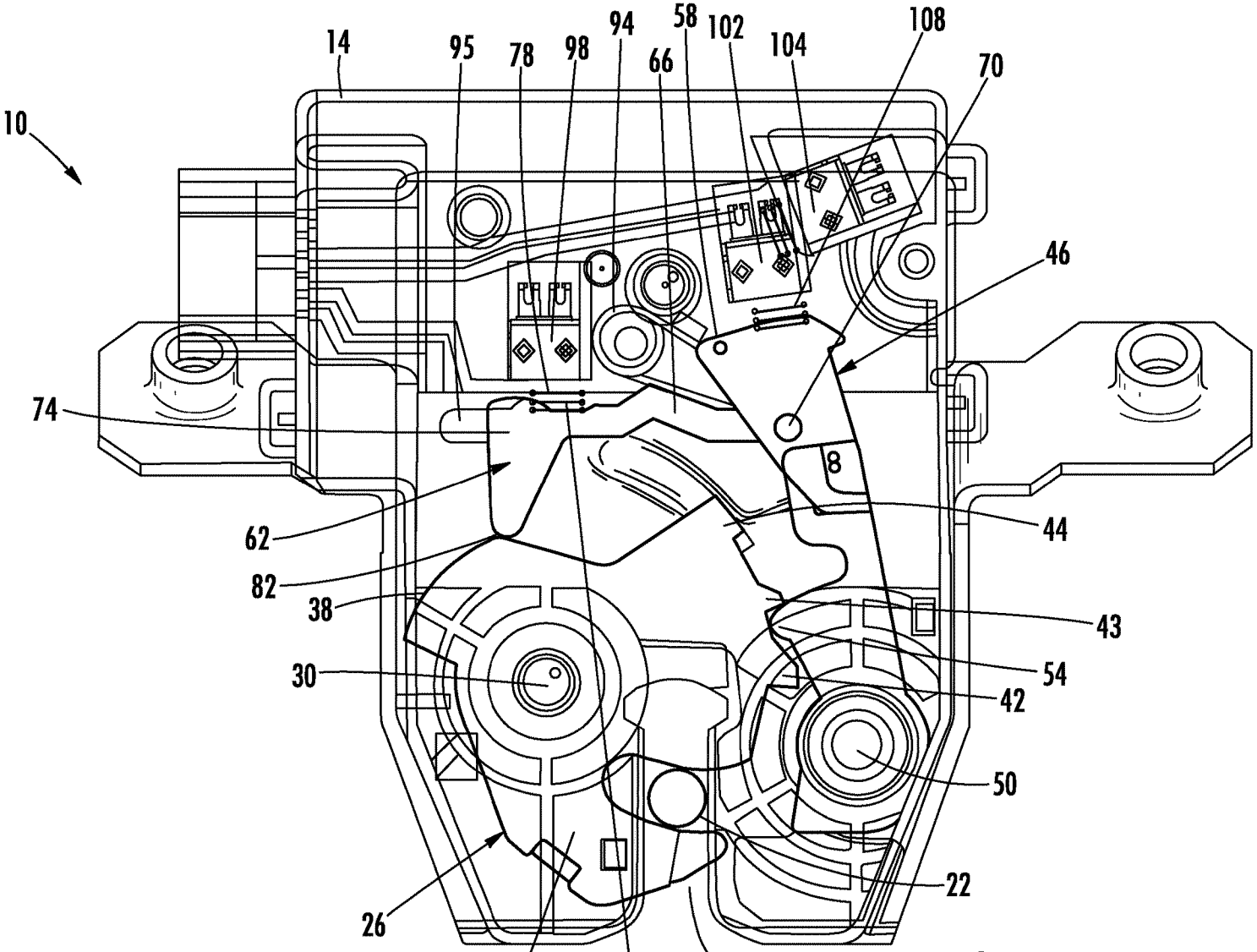
FIG. 4 is a cross-sectional view of the latch assembly of FIG. 1, illustrating a secondary position.
Figure 5:
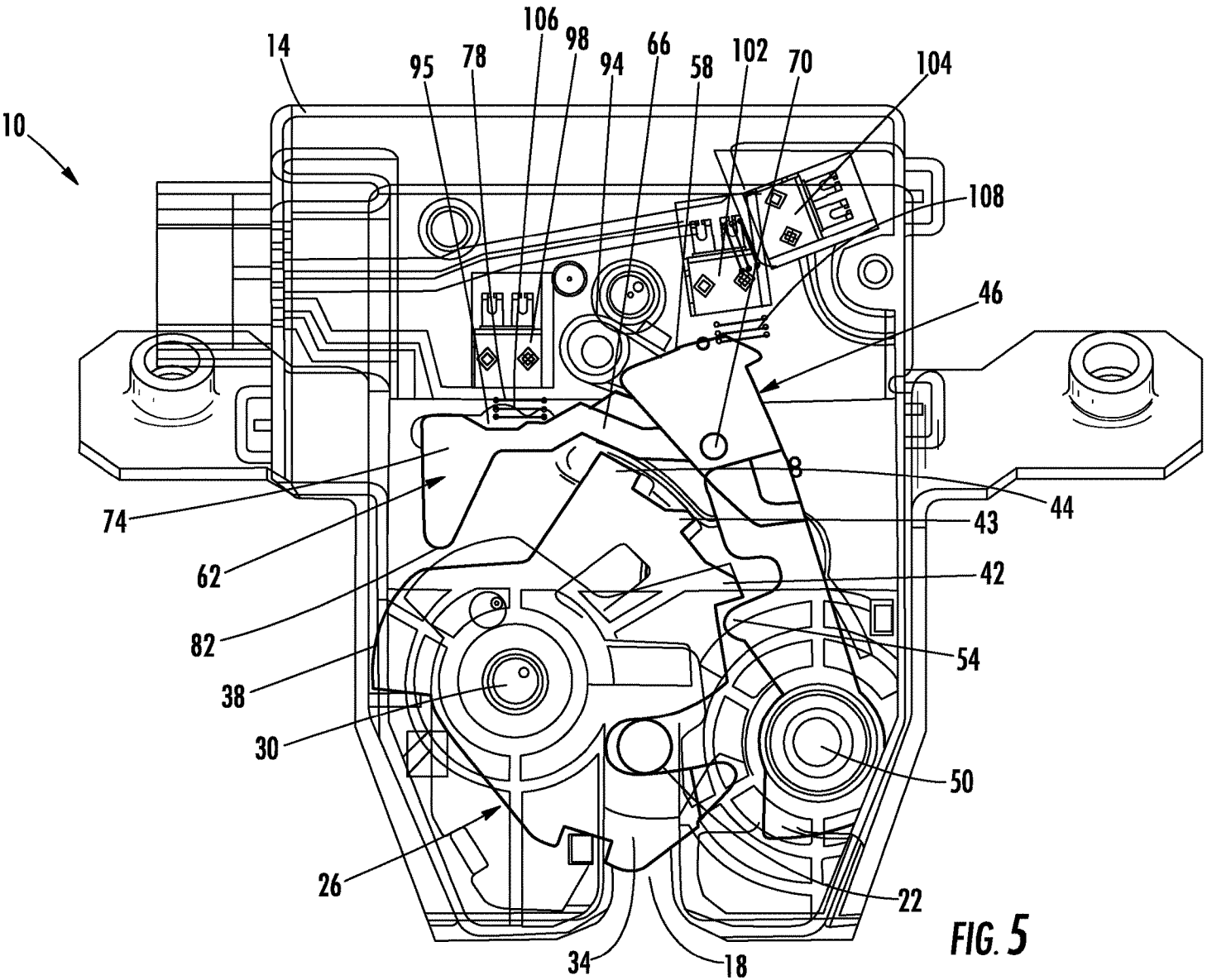
FIG. 5 is a cross-sectional view of the latch assembly of FIG. 1, illustrating a primary position.

With continued reference to FIGS. 1-5, the latch assembly 10 further includes a lever spring 94 disposed at least partially within the housing 14 that biases the second end 74 of the lever 62 toward the forkbolt 26. In the illustrated construction, the lever spring 94 biases the lever 62 such that the lever engaging surface 82 maintains contact with the forkbolt engagement surface 38 as the detent 46 pivots about the detent pivot point 50. As illustrated in FIGS. 1-5, the housing 14 includes an elongate slot 95. The second end 74 of the lever 62 rides along this slot 95 (e.g., via a pin or other structure that slides within the slot 95) as the detent 46 is rotated. Thus, the second end 74 moves (e.g., generally linearly) and maintains contact with the forkbolt 26, until (as illustrated in FIG. 5) the forkbolt engagement surface 38 is no longer in contact with the lever 62.

The latch assembly 10 further includes a first switch 98, a second switch 102, and a neutral switch 104, each disposed at least partially within the housing 14 (e.g., on a printed circuit board within the housing 14). The switches 98, 102, 104 are used for example to determine positions of the lever 62 and/or detent 46, and thus also positions of the forkbolt 26. In the illustrated construction, the first switch 98 may be used to detect a position of both the forkbolt 26 and the combined lever 62 and detent 46. The term "switch" as used herein includes any type of sensor.

In the illustrated construction, the first switch 98 includes a first switch button 106 that is compressible. As illustrated in FIGS. 1-5, in at least one position of the lever 62, the lever sensed surface 78 contacts and presses against the first switch button 106, thereby compressing the first switch button 106 and activating the first switch 98 (e.g., from a zero state to a non-zero state). Other constructions do not include a first switch button 106. Rather, the first switch 98 is a proximity sensor (e.g., inductive or capacitive), and the lever 62 includes for example one or more metallic (e.g., ferrous) or magnetic regions that are detected by the first switch 98.

Figure 2:
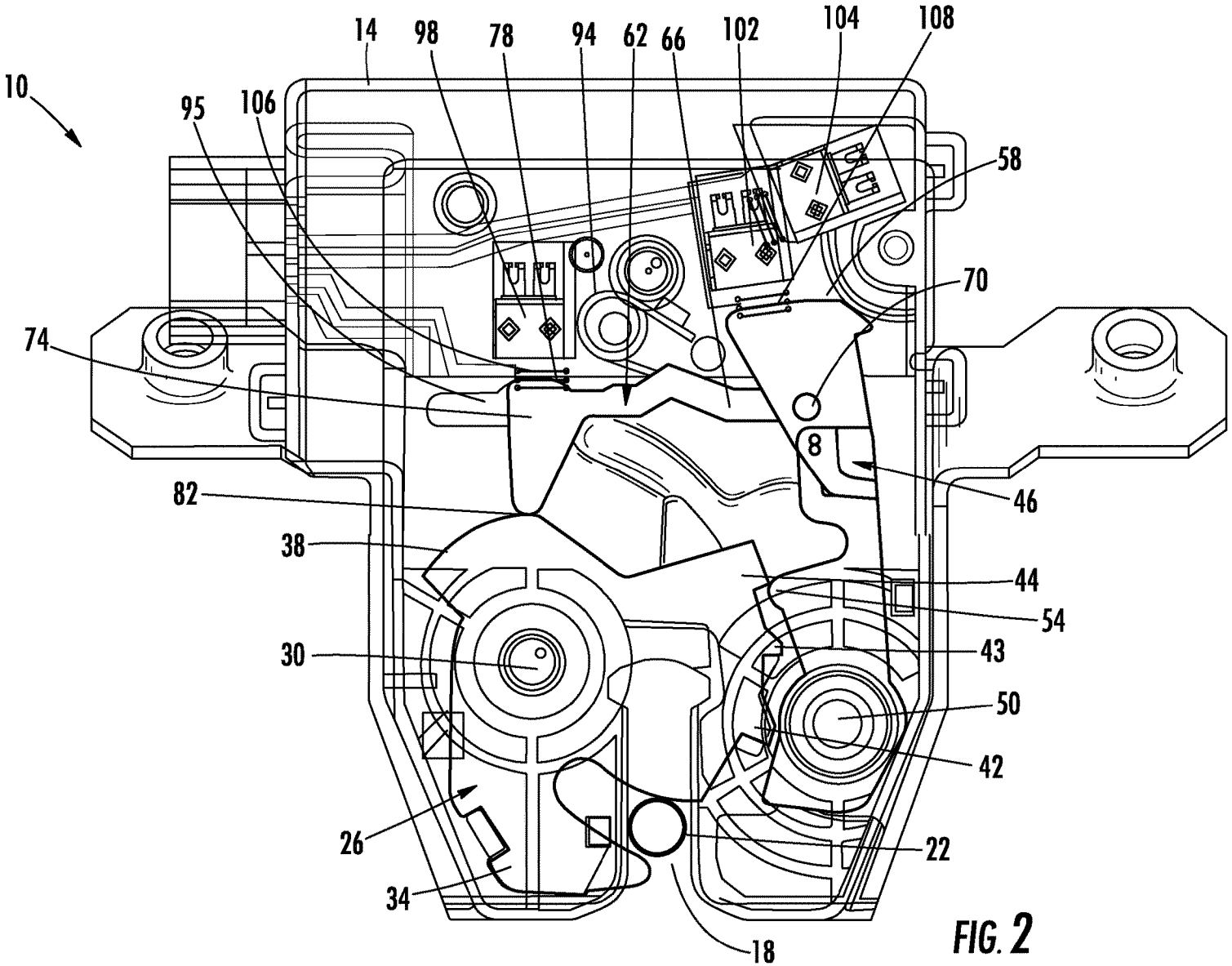
FIG. 2 is a cross-sectional view of the latch assembly of FIG. 1, illustrating a pre-tertiary position.

In the illustrated construction, the second switch 102 includes a second switch button 108 that is compressible. As illustrated in FIGS. 1-3, in at least one position of the detent 46, the detent sensed surface 58 contacts and presses against the second switch button 108, thereby compressing the second switch button 108 and activating the second switch 102 (e.g., from a zero state to a non-zero state). In the illustrated construction the detent sensed surface 58 is generally planar, although in other constructions the detent sensed surface 58 may include a raised portion or cam surface that contacts the second switch 102. Additionally, in some constructions the second switch button 108 is not provided. Rather, the second switch 102 is a proximity sensor (e.g., inductive or capacitive), and the detent 46 includes for example one or more metallic (e.g., ferrous) or magnetic regions that are detected by the second switch 102.

Figure 6:
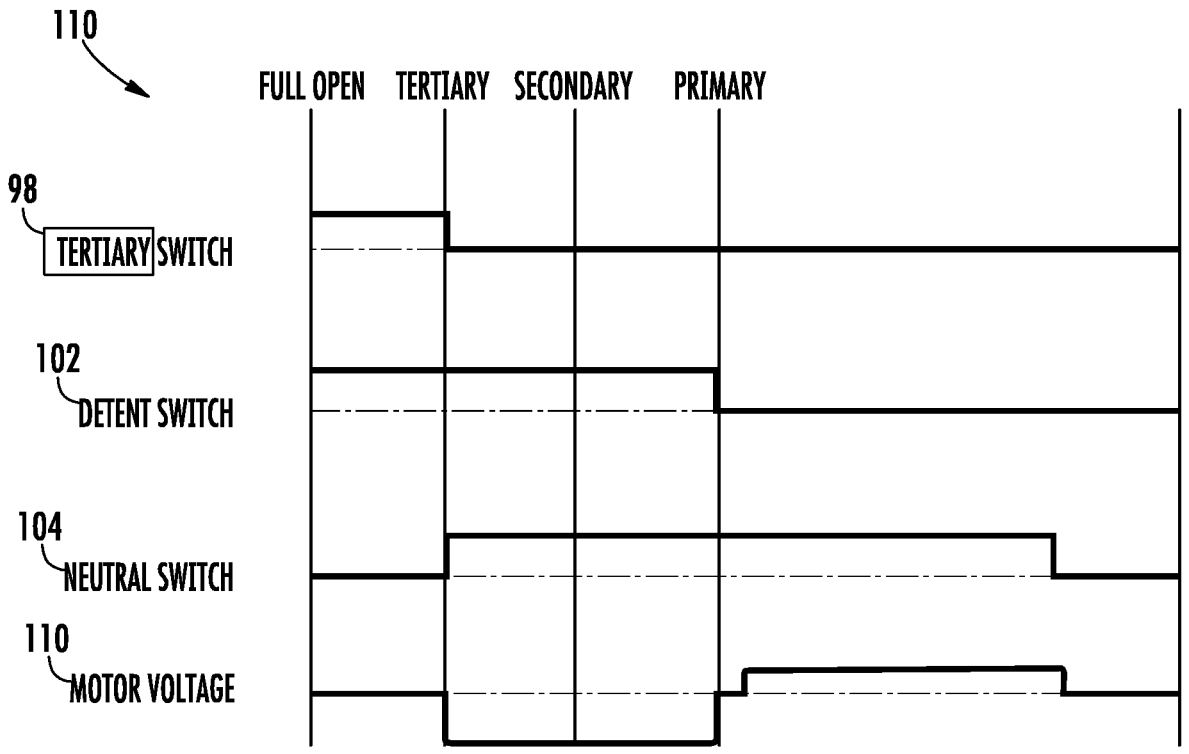
FIG. 6 is a chart illustrating a sensor and control logic according to one construction for the latch assembly of FIG. 1.

With reference to FIGS. 1-6, during operation of the latch assembly 10 the forkbolt 26 is initially in a fully open position (FIG. 1). In the fully open position the forkbolt 26 has been fully rotated in a clockwise manner, such that the main arm 34 of the forkbolt 26 is disposed outside of the fishmouth 18. The detent latching projection 54 is in contact with an exterior of the third forkbolt latching projection 44. The detent sensed surface 58 is in communication with the second switch 102 (e.g., via the second switch button 108), and the lever sensed surface 78 is in communication with the first switch 98 (e.g., via the first switch button 106). Thus, as illustrated in FIG. 6, both the first switch 98 (referenced as a "Tertiary Switch" in FIG. 6) and the second switch 102 (referenced as a "Detent Switch" in FIG. 6) are activated. The neutral switch 104 is not activated.

With reference to FIG. 2, during operation an operator moves the striker 22 toward the housing 14 and into the fishmouth 18 (e.g., by pulling down on a hood, rear compartment, or other compartment of the motor vehicle), such that the striker 22 contacts the forkbolt 26 and begins to rotate the forkbolt 26 in a counterclockwise direction. In this position of the forkbolt 26 (a "pre-tertiary position"), a portion of the main arm 34 of the forkbolt 26 has moved into the fishmouth 18. The third forkbolt latching projection 44 has moved (i.e., has rotated counterclockwise) such that the detent latching projection 54 is near to engaging under the third forkbolt latching projection 44. The detent sensed surface 58 is still in communication with the second switch 102, and the lever sensed surface 78 is still in communication with the first switch 98.

With reference to FIG. 3, during operation the forkbolt 26 continues to rotate further to a tertiary position (e.g., due to pressing of the hood, rear compartment, or other compartment by the operator), and the detent 46 rotates counterclockwise, such that the detent latching projection 54 is engaged under the third forkbolt latching projection 44 (thereby at least temporarily engaging and "locking" the forkbolt 26 to the detent 46). The detent sensed surface 58 is still in communication with the second switch 102. The lever sensed surface 78, however, has moved out of communication with the first switch 98, due to the movement of the lever 62 and the spring-biasing effect of the lever spring 94, which has forced the second end 74 of the lever 62 down to maintain contact with the forkbolt engagement surface 38. Thus, as illustrated in FIG. 6, when the forkbolt 26 reaches this position, the first switch 98 switches off, and a motor 110 (illustrated schematically in FIG. 3) coupled to the forkbolt 26 (e.g., via one or more gears such as a worm gear) activates to begin a cinching operation with an engaged tertiary position between the forkbolt 26 and the detent 46. When the motor 110 has been activated, the neutral switch 104 is then switched on.

The cinching operation is an operation in which the motor 110 continues to rotate the forkbolt 26 in a counterclockwise direction until the detent latching projection 54 engages the second forkbolt latching projection 43 (referenced as a "secondary position"), and in some constructions further still until the detent latching projection 54 engages the first forkbolt latching projection 42 (referenced as a "primary position"). FIGS. 4 and 5 illustrate this further movement.

As illustrated in FIG. 6, during this cinching operation the first switch 98 remains inactive, and both the second switch 102 and the neutral switch 104 remain active as the forkbolt 26 moves through the secondary position toward the primary position. When the forkbolt 26 reaches the primary position, the second switch 102 deactivates (i.e., because the detent sensed surface 58 is no longer in communication with the second switch 102. The cinching operation may occur autonomously, and may be used for example if the operator has not pressed hard enough down on the compartment of the motor vehicle. Other constructions include different cinching operations than that illustrated.

As illustrated in FIG. 3, in some constructions the neutral switch 104 interfaces with a sector gear 112, which is coupled to the motor 110. The sector gear 112 may interface for example with a forkbolt/cinching lever (not illustrated) for closing the forkbolt 26 (i.e. rotating the forkbolt 26 to the primary position). The sector gear 112 may also interface with the detent 46 for opening the forkbolt 26 (i.e., rotating the detent 46 to allow the forkbolt 26 to rotate to the fully open position). In some constructions, the neutral switch 104 interfaces with the sector gear 112 such that after the cinching operation the sector gear 112 returns to a "home" position. The motor 110 will reverse (see for example FIG. 6) until the neutral switch 104 is no longer activated (e.g., a button on the neutral switch is no longer compressed by the sector gear 112 or other component).

In some constructions, the forkbolt 26 moves (e.g., rotates) between a number of different positions other than those illustrated. For example, in some construction the forkbolt 26 includes only two latching projections, as opposed to the three forkbolt latching projections 42, 43, 44 described above. Thus, the forkbolt 26 may move from a fully open position to a secondary position and then to the primary position. Other constructions include different movements of the forkbolt 26.

In some constructions, the lever 62 is positioned to contact the first switch 98 at times other than when the forkbolt 26 is in the fully open position or in a position between the fully open position and the tertiary position. For example, in some constructions the lever 62 (e.g., the second end 74 of the lever 62) contacts the first switch 98 (e.g., presses against the first switch button 106) when the forkbolt 26 is in the secondary position, or in the primary position, or in positions between the primary position, the secondary position, and/or the tertiary position. Additionally, in some constructions the detent 46 is positioned to be out of communication with (i.e., disengaged from) the second switch 102 during one or more of the primary, secondary, and/or tertiary positions of the forkbolt 26. Thus, various other arrangements of the first switch 98 and the second switch 102 are also possible to monitor locations and/or rotational positions of the forkbolt 26, the detent 46.

In some constructions, when the operator desires to unlatch the compartment and release the striker 22, the motor 110 may be used to selectively rotate the detent 46 (clockwise). Rotating the detent 46 allows the forkbolt 26 to also rotate (clockwise), until the forkbolt 26 eventually reaches the fully open position (FIG. 1) and the striker 22 is released.

FIGS. 7-10 illustrate a latch assembly 210. The latch assembly 210 is similar to the latch assembly 10. Thus, like components are given like reference numbers, increased by 200. While the latch assembly 210 is primarily intended for use with a commercial motor vehicle (e.g., sedan, SUV, minivans, trucks, etc.) for a cinching rear compartment latch, the latch assembly 210 may also be used with other types of machines or vehicles where a latch assembly 210 may be beneficial to control operation of a compartment.

Figure 7:
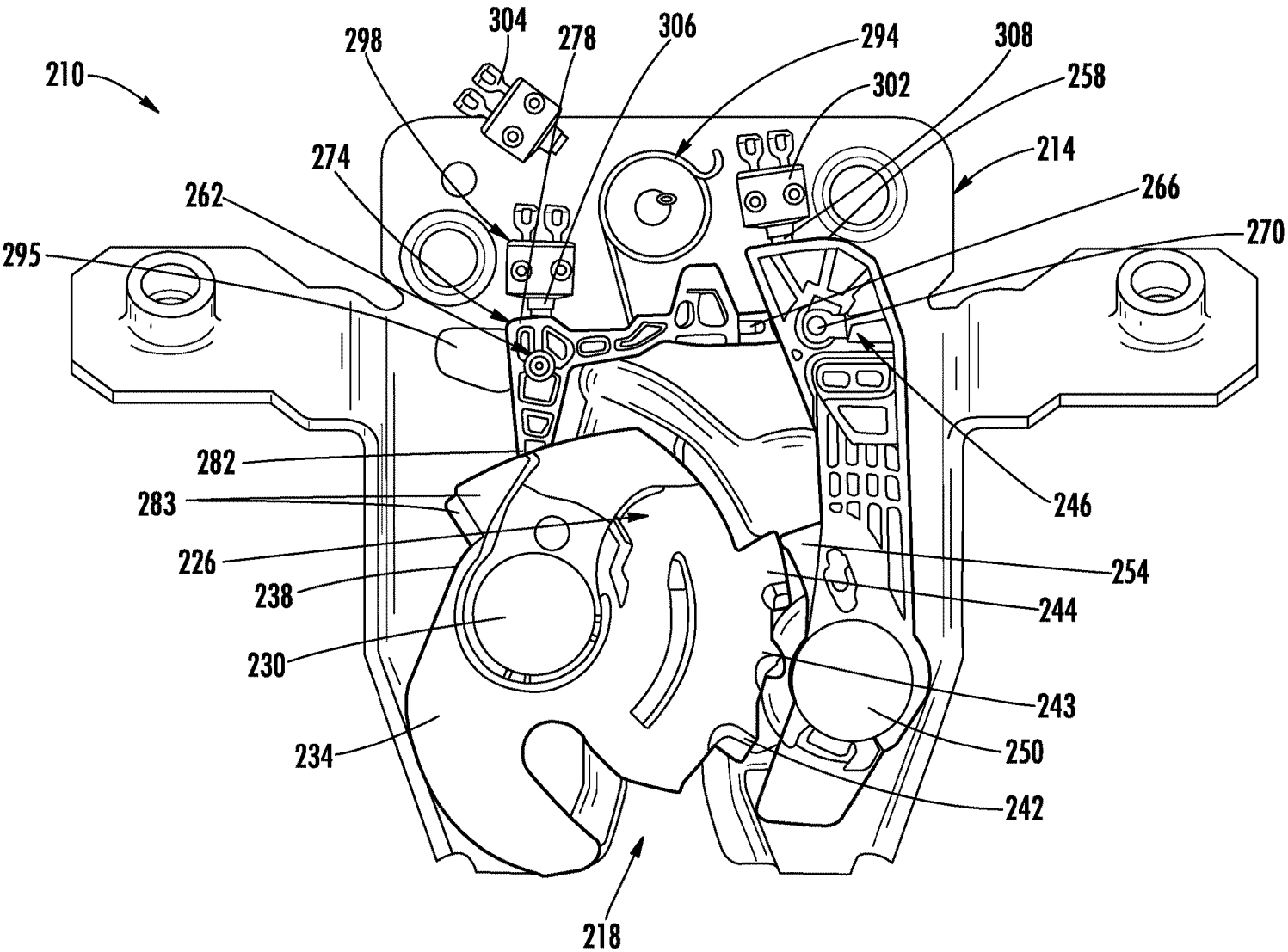
FIG. 7 is a cross-sectional view of a latch assembly according to another construction, illustrating a fully open position.
Figure 8:
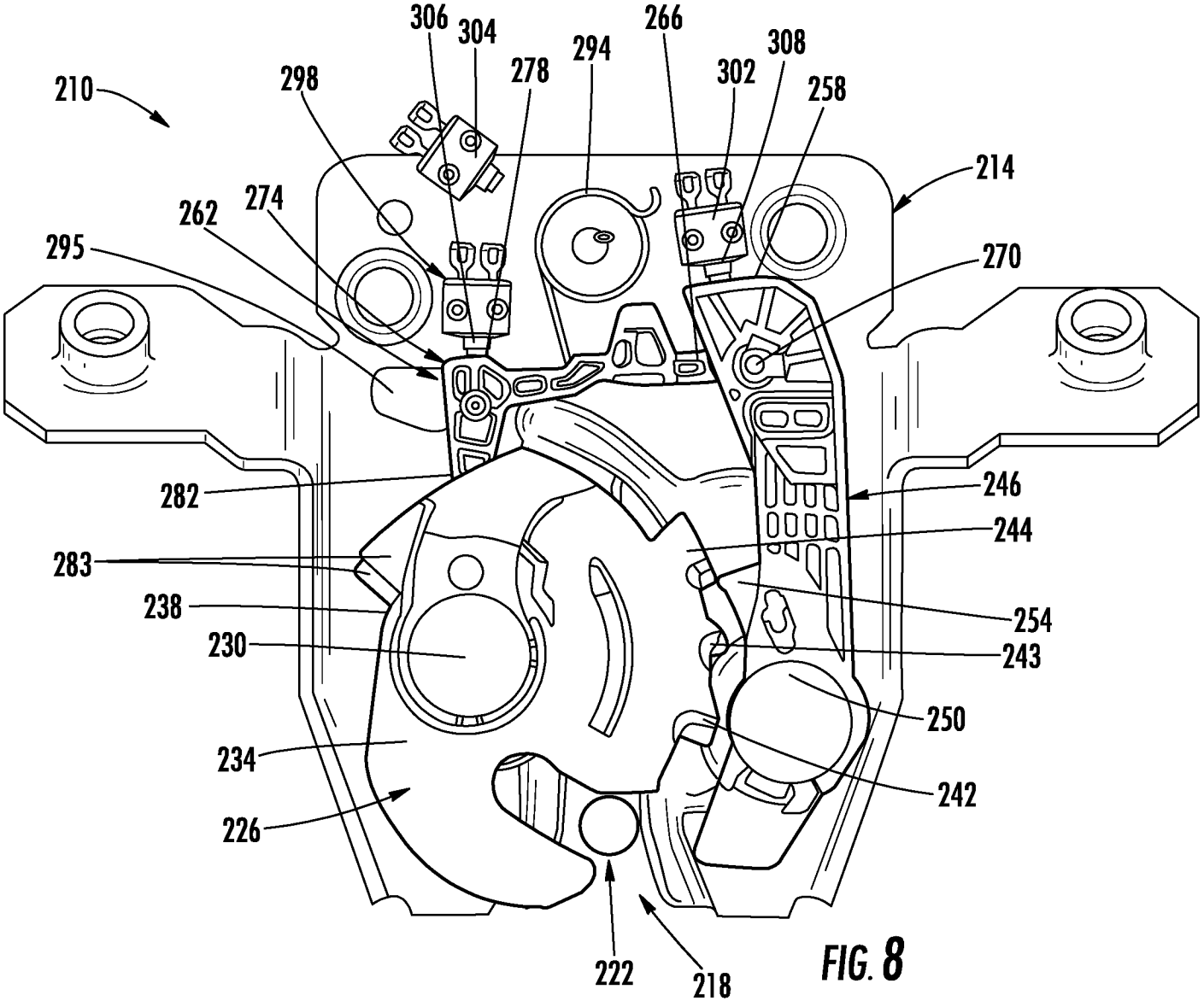
FIG. 8 is a cross-sectional view of the latch assembly of FIG. 7, illustrating a pre-tertiary position.
Figure 9:
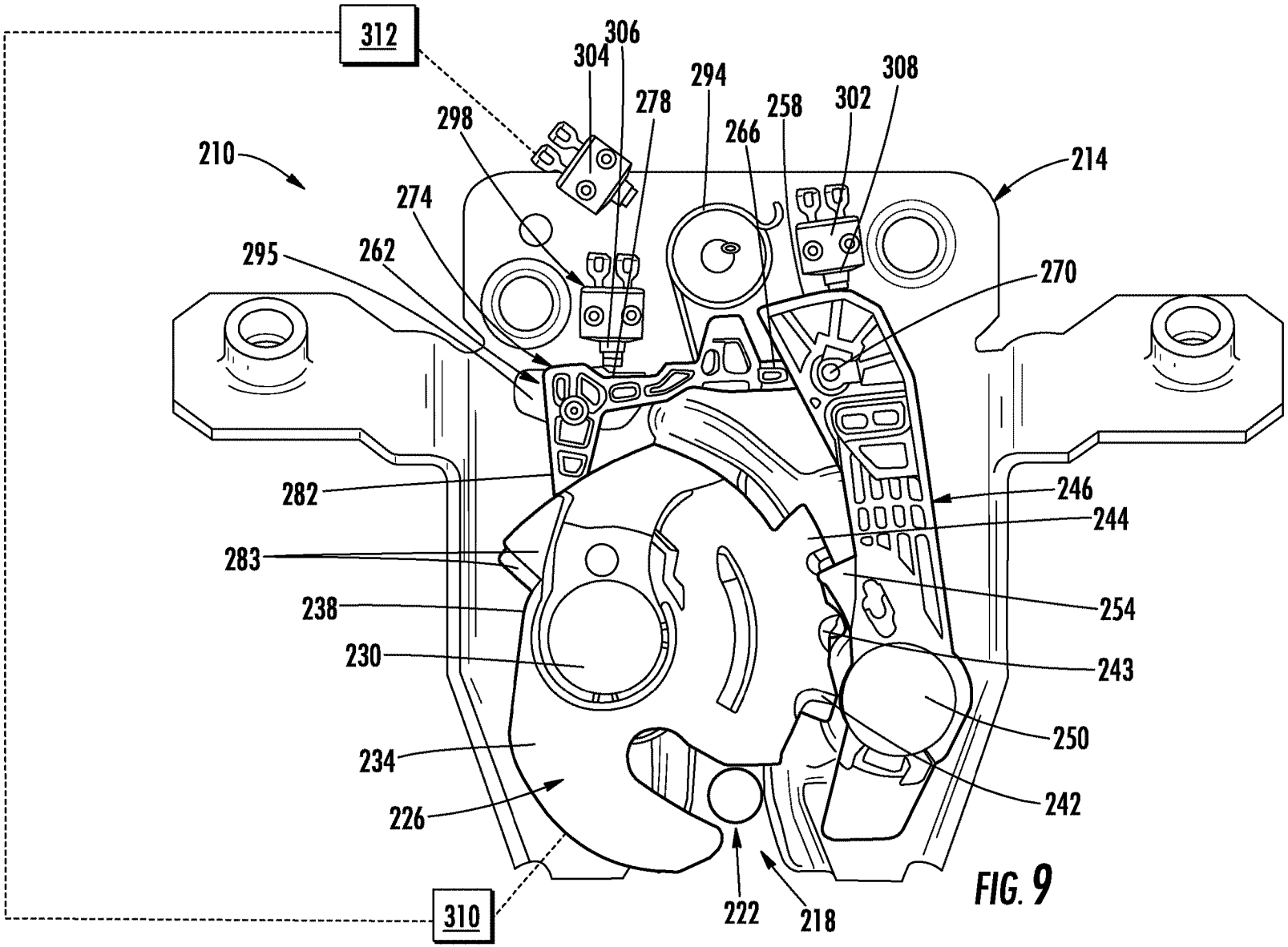
FIG. 9 is a cross-sectional view of the latch assembly of FIG. 7, illustrating the tertiary position.

With reference to FIGS. 7-9, the latch assembly 210 includes a housing 214 defining a fishmouth (i.e., slot) 218 that is sized and shaped to receive a striker 222 (illustrated schematically in FIGS. 8 and 9) of a compartment of a motor vehicle. The housing 214 may have shapes and sizes other than that illustrated. In some constructions, the housing 214 is coupled (e.g., fixed) directly to an interior of a motor vehicle, adjacent a compartment of the motor vehicle.

The latch assembly 210 further includes a forkbolt (i.e., catch) 226 disposed at least partially within the housing 214. The forkbolt 226 rotates about a forkbolt pivot point 230 (e.g., pin) in the housing 214. In the illustrated construction, the forkbolt 226 is biased (e.g., with a torsion spring or other biasing element) to rotate clockwise about the forkbolt pivot point 230, although other constructions include different rotational directions or movement of the forkbolt 226, as well as different biasing elements to bias the forkbolt 226. In the illustrated construction, the forkbolt 226 includes a forkbolt main arm 234, a forkbolt engagement surface 238 (e.g., a cam surface), a first forkbolt latching projection 242, a second forkbolt latching projection 243, and a third forkbolt latching projection 244.

With continued reference to FIGS. 7-9, the latch assembly 210 further includes a detent (i.e., pawl) 246 disposed at least partially within the housing 214. The detent 246 rotates about a detent pivot point 250 (e.g., pin) in the housing 214. In the illustrated construction, the detent 246 is biased (e.g., with a torsion spring or other biasing element) to rotate counter-clockwise about the detent pivot point 250, although other constructions include different rotational directions or movement of the detent 246, as well as different biasing elements to bias the detent 246. In the illustrated construction, the detent 246 includes a detent latching projection 254, and a detent sensed surface 258 at a distal end of the detent 246. The detent latching projection 254 is disposed between the detent sensed surface 258 and the detent pivot point 250.

The latch assembly 210 further includes a lever 262 disposed at least partially within the housing 214. The lever 262 is coupled to the detent 246, and is moved by the detent 246 during operation of the latch assembly 210. In the illustrated construction, the lever 262 includes a first end 266 that is coupled to the detent 246 at a point or area 270 (e.g., via press-fit, pivotal connection, integrally formation with the detent, a sliding connection via a slot, or other connection). The point or area 270 is disposed between the detent sensed surface 258 and the detent latching projection 254. The lever 262 further includes a second, opposite end 274 having a lever sensed surface 278 and a lever engaging surface 282. In the illustrated construction the second end 274 of the lever 262 has a generally enlarged (e.g., triangular) shape. The lever engaging surface 282 is a generally rounded surface (e.g., of small radius at an end), whereas the lever sensed surface 278 is generally larger and planar or in some constructions is curved or is a cam surface. In the illustrated construction the forkbolt 226 includes two protruding ribs or walls 283 at a top end of the forkbolt 226. As illustrated in FIGS. 7-9, a portion of the lever engaging surface 282 is partially concealed between the walls 283, and presses against the forkbolt engagement surface 238 that extends, for example, between the two walls 283. Other constructions include different shapes and sizes for the lever 262 and its various surfaces and regions other than that illustrated.

With continued reference to FIGS. 7-9, the latch assembly 210 further includes a lever spring 294 disposed at least partially within the housing 214 that biases the second end 274 of the lever 262 toward the forkbolt 226. In the illustrated construction, the lever spring 294 biases the lever 262 such that the lever engaging surface 282 maintains contact with the forkbolt engagement surface 238 as the detent 246 pivots about the detent pivot point 250. As illustrated in FIGS. 7-9, the housing 214 includes an elongate slot 295. The second end 274 of the lever 262 rides along this slot 295 (e.g., via a pin or other structure that slides within the slot 295) as the detent 246 is rotated. Thus, the second end 274 moves (e.g., generally linearly) and maintains contact with the forkbolt 226, until the forkbolt engagement surface 238 is no longer in contact with the lever 262. As illustrated in FIGS. 7-9, the elongate slot 295 has a slightly different shape and profile than that of the elongate slot 95 in the embodiment of FIGS. 1-5. Other constructions include various other shapes and sizes of elongate slots within which the levers 62, 262 ride.

The latch assembly 210 further includes a first switch 298, a second switch 302, and a neutral switch 304, each disposed at least partially within the housing 214 (e.g., on a printed circuit board within the housing 214). As illustrated in FIGS. 7-9, the neutral switch 304 is disposed at a different location than the neutral switch 104 in the embodiment of FIGS. 1-5. Other constructions include various other locations and positions for the switches 298, 302, 304. The switches 298, 302, 304 are used for example to determine positions of the lever 262 and/or detent 246, and thus also positions of the forkbolt 226. In the illustrated construction, the first switch 298 may be used to detect a position of both the forkbolt 226 and the combined lever 262 and detent 246.

In the illustrated construction, the first switch 298 includes a first switch button 306 that is compressible. As illustrated in FIGS. 7-9, in at least one position of the lever 262, the lever sensed surface 278 contacts and presses against the first switch button 306, thereby compressing the first switch button 306 and activating the first switch 298 (e.g., from a zero state to a non-zero state). Other constructions do not include a first switch button 306. Rather, the first switch 298 is a proximity sensor (e.g., inductive or capacitive), and the lever 262 includes for example one or more metallic (e.g., ferrous) or magnetic regions that are detected by the first switch 298.

In the illustrated construction, the second switch 302 includes a second switch button 308 that is compressible. As illustrated in FIGS. 7-9, in at least one position of the detent 246, the detent sensed surface 258 contacts and presses against the second switch button 308, thereby compressing the second switch button 308 and activating the second switch 302 (e.g., from a zero state to a non-zero state). In the illustrated construction the detent sensed surface 258 is generally planar, although in other constructions the detent sensed surface 258 may include a raised portion or cam surface that contacts the second switch 302. Additionally, in some constructions the second switch button 308 is not provided. Rather, the second switch 302 is a proximity sensor (e.g., inductive or capacitive), and the detent 246 includes for example one or more metallic (e.g., ferrous) or magnetic regions that are detected by the second switch 302.

Figure 10:
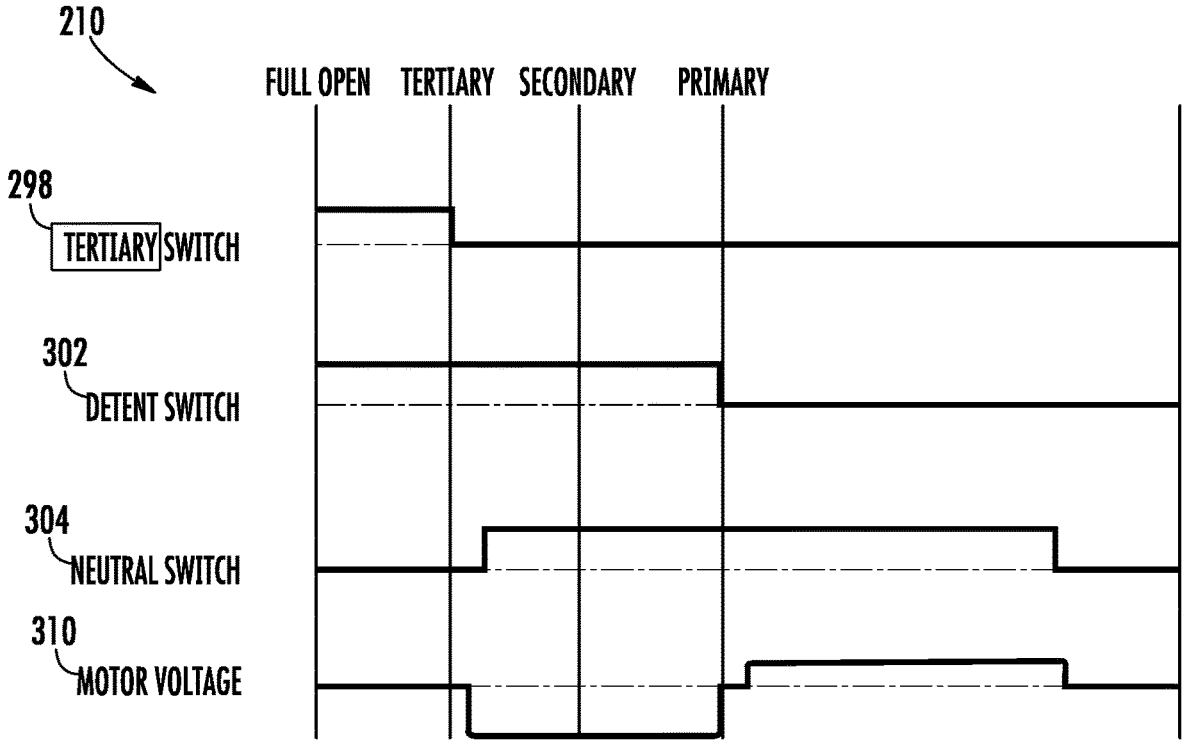
FIG. 10 is a chart illustrating a sensor and control logic according to one construction for the latch assembly of FIG. 7.

With reference to FIGS. 7-10, during operation of the latch assembly 210 the forkbolt 226 is initially in a fully open position (FIG. 7). In the fully open position the forkbolt 226 has been fully rotated in a clockwise manner, such that the main arm 234 of the forkbolt 226 is disposed outside of the fishmouth 218. The detent latching projection 254 is in contact with an exterior of the third forkbolt latching projection 244. The detent sensed surface 258 is in communication with the second switch 302 (e.g., via the second switch button 308), and the lever sensed surface 278 is in communication with the first switch 298 (e.g., via the first switch button 306). Thus, as illustrated in FIG. 10, both the first switch 298 (referenced as a "Tertiary Switch" in FIG. 10) and the second switch 302 (referenced as a "Detent Switch" in FIG. 10) are activated. The neutral switch 304 is not activated.

With reference to FIG. 8, during operation an operator moves the striker 222 toward the housing 214 and into the fishmouth 218 (e.g., by pulling down on a hood, rear compartment, or other compartment of the motor vehicle), such that the striker 222 contacts the forkbolt 226 and begins to rotate the forkbolt 226 in a counterclockwise direction. In this position of the forkbolt 226 (a "pre-tertiary position"), a portion of the main arm 234 of the forkbolt 226 has moved into the fishmouth 218. The third forkbolt latching projection 244 has moved (i.e., has rotated counterclockwise) such that the detent latching projection 254 is near to engaging under the third forkbolt latching projection 244. The detent sensed surface 258 is still in communication with the second switch 302, and the lever sensed surface 278 is still in communication with the first switch 298.

With reference to FIG. 9, during operation the forkbolt 226 continues to rotate further to the tertiary position (e.g., due to pressing of the hood, rear compartment, or other compartment by the operator), and the detent 246 rotates counterclockwise, such that the detent latching projection 254 is engaged under the third forkbolt latching projection 244 (thereby at least temporarily engaging and "locking" the forkbolt 226 to the detent 246). The detent sensed surface 258 is still in communication with the second switch 302. The lever sensed surface 278, however, has moved out of communication (i.e., becomes disengaged) with the first switch 298, due to the movement of the lever 262 and the spring-biasing effect of the lever spring 294, which has forced the second end 274 of the lever 262 down to maintain contact with the forkbolt engagement surface 238. The shape and configuration of the elongate slot 295 may facilitate this disengagement. For example, the elongate slot 295 may include one or more ramped or inclined surfaces that help to move the second end 274 away from the first switch 298. As illustrated in FIG. 10, when the forkbolt 226 reaches the tertiary position, the first switch 298 switches off. Shortly thereafter, a motor 310 (illustrated schematically in FIG. 9) coupled to the forkbolt 226 (e.g., via one or more gears such as a worm gear) activates to begin a cinching operation with an engaged tertiary position between the forkbolt 226 and the detent 246. When the motor 310 has been activated, the neutral switch 304 is then switched on. As illustrated in FIG. 10, the cinching operation may begin shortly after the tertiary position is reached. Alternatively, as illustrated in FIG. 6, the cinching operation may begin generally at the same time the tertiary position is reached. Any of the embodiments described herein may implement the operations illustrated in FIG. 6, FIG. 10, or variations and alterations thereof.

With continued reference to FIGS. 7-10, the cinching operation is an operation in which the motor 310 continues to rotate the forkbolt 226 in a counterclockwise direction until the detent latching projection 254 engages the second forkbolt latching projection 243 (referenced as a "secondary position"), and in some constructions further still until the detent latching projection 254 engages the first forkbolt latching projection 242 (referenced as a "primary position").

As illustrated in FIG. 10, during this cinching operation the first switch 298 remains inactive, and both the second switch 302 and the neutral switch 304 remain active as the forkbolt 226 moves through the secondary position toward the primary position. When the forkbolt 226 reaches the primary position, the second switch 302 deactivates (i.e., because the detent sensed surface 258 is no longer in communication with the second switch 302. The cinching operation may occur autonomously, and may be used for example if the operator has not pressed hard enough down on the compartment of the motor vehicle. Other constructions include different cinching operations than that illustrated.

As illustrated in FIG. 9, in some constructions the neutral switch 304 interfaces with a sector gear 312 (illustrated schematically in FIG. 9), which is coupled to the motor 310. The sector gear 312 may interface for example with a forkbolt/cinching lever (not illustrated) for closing the forkbolt 226 (i.e. rotating the forkbolt 226 to the primary position). The sector gear 312 may also interface with the detent 246 for opening the forkbolt 226 (i.e., rotating the detent 246 to allow the forkbolt 226 to rotate to the fully open position). In some constructions, the neutral switch 304 interfaces with the sector gear 312 such that after the cinching operation the sector gear 312 returns to a "home" position. The motor 310 will reverse (see for example FIG. 10) until the neutral switch 304 is no longer activated (e.g., a button on the neutral switch is no longer compressed by the sector gear 312 or other component).

In some constructions, the forkbolt 226 moves (e.g., rotates) between a number of different positions other than those illustrated. For example, in some construction the forkbolt 226 includes only two latching projections, as opposed to the three forkbolt latching projections 242, 243, 244 described above. Thus, the forkbolt 226 may move from a fully open position to a secondary position and then to the primary position. Other constructions include different movements of the forkbolt 226.

In some constructions, the lever 262 is positioned to contact the first switch 298 at times other than when the forkbolt 226 is in the fully open position or in a position between the fully open position and the tertiary position. For example, in some constructions the lever 262 (e.g., the second end 274 of the lever 262) contacts the first switch 298 (e.g., presses against the first switch button 306) when the forkbolt 226 is in the secondary position, or in the primary position, or in positions between the primary position, the secondary position, and/or the tertiary position. Additionally, in some constructions the detent 246 is positioned to be out of communication with (i.e., disengaged from) the second switch 302 during one or more of the primary, secondary, and/or tertiary positions of the forkbolt 226. Thus, various other arrangements of the first switch 298 and the second switch 302 are also possible to monitor locations and/or rotational positions of the forkbolt 226, the detent 246.

In some constructions, when the operator desires to unlatch the compartment and release the striker 222, the motor 310 may be used to selectively rotate the detent 246 (clockwise). Rotating the detent 246 allows the forkbolt 226 to also rotate (clockwise), until the forkbolt 226 eventually reaches the fully open position (FIG. 7) and the striker 222 is released.

Although the invention has been described in detail with reference to certain preferred embodiments, variations and modifications exist within the scope and spirit of one or more independent aspects of the invention as described.

What is claimed is:

1. A latch assembly comprising:

a forkbolt biased by a first biasing element to rotate in a first direction about a first pivot point;

a detent biased by a second biasing element to rotate in a second direction about a second pivot point, wherein the second direction is opposite to the first direction, wherein the second pivot point is separate from the first pivot point, and wherein the detent is configured to engage with the forkbolt in at least two different positions;

a lever having a first end pivotally coupled to the detent and a second end biased toward the forkbolt, wherein the first end of the lever is pivotally coupled to the detent about a third pivot point that is separate from the first pivot point and the second pivot point, and wherein the second end of the lever is biased by a third biasing element to rotate in the second direction toward the forkbolt; and a switch configured to detect a position of both the forkbolt and the combined lever and detent.

2. The latch assembly of claim 1, wherein the switch is configured to detect a surface of the second end of the lever.

3. The latch assembly of claim 1, wherein the second end of the lever is configured to be selectively in and out of contact with the forkbolt during operation of the latch assembly.

4. The latch assembly of claim 3, wherein the second end of the lever includes a first surface configured to be detected by the switch, and a second surface opposite to the first surface configured to be selectively in and out of contact with a surface of the forkbolt.

5. The latch assembly of claim 1, wherein the forkbolt includes a first forkbolt latching projection, a second forkbolt latching projection, and a third forkbolt latching projection.

6. The latch assembly of claim 5, wherein the detent includes a detent latching projection configured to engage the first, second, and third forkbolt latching projections based on rotational movements of the forkbolt and detent.

7. The latch assembly of claim 6, wherein the detent includes a detent sensed surface, wherein the switch is a first switch, and wherein the latch assembly includes a second switch configured to detect the detent sensed surface.

8. The latch assembly of claim 7, wherein the first end of the lever is coupled to the detent at a point or area on the detent that is disposed between the detent sensed surface and the detent latching projection.

9. The latch assembly of claim 1, further comprising a housing having a slot, wherein a portion of the second end of the lever is configured to slide within the slot.

10. The latch assembly of claim 9, wherein the portion of the second end of the lever is configured to slide within the slot from a first position where the lever is detected by the switch, to a second position where the lever is not detected by the switch.

11. The latch assembly of claim 1, wherein the switch is a first switch configured to detect a surface of the lever, wherein the latch assembly further includes a second switch configured to detect a surface of the detent.

12. The latch assembly of claim 11, wherein when the latch assembly is in a fully open state, both the first and second switches are configured to be in an activated state.

13. The latch assembly of claim 11, wherein when the latch assembly is in a tertiary state, the second switch is configured to be in an activated state and the first switch is configured to be in a deactivated state.

14. The latch assembly of claim 13, further comprising a motor coupled to the forkbolt, wherein the motor is configured to rotate the forkbolt after the latch assembly has reached the tertiary state.

15. The latch assembly of claim 11, wherein when the latch assembly is in a primary state, both the first and second switches are configured to be in a deactivated state.

16. The latch assembly of claim 1, wherein the detent is configured to engage and disengage the forkbolt to limit rotation of the forkbolt, and wherein the lever is a separate component from the detent and is configured to move with the detent when the detent rotates in the second direction.

17. The latch assembly of claim 1, wherein the first biasing element is a first spring, wherein the second biasing element is a second spring, and wherein the third biasing element is a third spring.

18. A latch assembly comprising:

a housing;

a forkbolt rotatably coupled to the housing, the forkbolt biased to rotate in a first direction about a first pivot point;

a motor coupled to the forkbolt;

a detent rotatably coupled to the housing, the detent biased to rotate in a second direction about a second pivot point, wherein the second direction is opposite to the first direction;

a lever coupled to the detent;

a first switch configured to detect a surface of the lever;

a second switch configured to detect a surface of the detent by contacting with the surface of the detent;

wherein the first switch is configured to detect a position of both the forkbolt and the combined detent and lever, wherein the first switch is configured to transition between an activated and a deactivated state based on movement of the forkbolt and the combined detent and lever, wherein the latch assembly is configured such that when the latch assembly is being operated into a tertiary state, the second switch is configured to remain in contact with the surface of the detent, so as to activate the second switch, and when the latch assembly has reached the tertiary state, the surface of the lever is configured to have moved away from the switch, so as to place the first switch in the deactivated state, and wherein the motor is configured to rotate the forkbolt after the latch assembly has reached the tertiary state.

19. The latch assembly of claim 18, wherein the first switch includes a first compressible switch button and the second switch includes a second compressible switch button.

20. The latch assembly of claim 18, wherein the forkbolt includes a first forkbolt latching projection, a second forkbolt latching projection, and a third forkbolt latching projection, and wherein the detent includes a detent latching projection configured to engage the first, second, and third forkbolt latching projections based on rotational movements of the forkbolt and detent.

21. The latch assembly of claim 18, wherein the housing includes an elongate slot, and wherein at least a portion of the lever is configured to slide within the elongate slot.

22. The latch assembly of claim 18, wherein the lever is pivotally coupled to the detent.

23. The latch assembly of claim 18, wherein when the latch assembly is in a fully open state, both the first and second switches are configured to be in an activated state, and wherein when the latch assembly is in a primary state, both the first and second switches are configured to be in a deactivated state.

24. The latch assembly of claim 18, wherein the detent is configured to engage and disengage the forkbolt to limit rotation of the forkbolt, and wherein the lever is a separate component from the detent and is configured to move with the detent when the detent rotates in the second direction.

25. The latch assembly of claim 18, wherein the second pivot point is separate from the first pivot point, wherein the lever is pivotally coupled to the detent about a third pivot point separate from the first and second pivot points, and wherein the latch assembly further comprises a second switch configured to detect a surface of the detent.

* * * * *